US006361656B1

(12) United States Patent
Rata

(10) Patent No.: US 6,361,656 B1
(45) Date of Patent: Mar. 26, 2002

(54) LOADING HOSE FOR USE IN A PAPER MACHINE DOCTOR OR COATING DEVICE

(75) Inventor: Ilkka Rata, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/443,568

(22) Filed: Nov. 19, 1999

(30) Foreign Application Priority Data

Nov. 20, 1998 (FI) ..... 980505 U

(51) Int. Cl.[7] ..... B31F 1/12

(52) U.S. Cl. ..... 162/281; 162/272; 162/199; 15/256.51; 15/308; 118/123; 118/126; 118/413

(58) Field of Search ..... 162/281, 272, 162/199; 15/256.51, 308; 118/123, 126, 413

(56) References Cited

U.S. PATENT DOCUMENTS 3,163,878 A * 1/1965 Smith et al. ..... 15/256.51

3,529,315 A * 9/1970 Dunlap et al. ..... 15/256.51

FOREIGN PATENT DOCUMENTS

FI 57290 7/1980 ..... D21G/3/00

* cited by examiner

*Primary Examiner*—Stanley S. Silverman
*Assistant Examiner*—M. Halpern
(74) *Attorney, Agent, or Firm*—Filders & Outland, P.C.

(57) ABSTRACT

A loading hose for use in a paper machine doctor or coating device, which loading hose is located between the doctor's or coating device's blade support and rotatably arranged blade holder, is arranged to load the doctor blade of the doctor or the coating blade of the coating device. The loading hose incorporates a flexible casing, which is pressure-resistant and of a uniform cross-section. The loading hose includes at least one stiffening member attached to the casing and arranged to lie against either the blade support or the blade holder.

12 Claims, 2 Drawing Sheets

LOADING HOSE FOR USE IN A PAPER MACHINE DOCTOR OR COATING DEVICE

FIELD OF THE INVENTION

This invention relates to a loading hose for use in a paper machine doctor or coating device, which loading hose lies between the doctor's or coating device's blade supports and rotatable blade holder. The loading hose is arranged to load the blade of the doctor or the coating blade of the coating device, and has a flexible, pressure-resistant casing of uniform cross-section.

BACKGROUND OF THE INVENTION

In a hose-loaded doctor in a paper machine, the contact force of the doctor blade on the surface of the roll being cleaned, or, in coating devices, the contact force of the coating blade on the surface being coated, is increased by means of loading hoses acting on the blade holder. Generally, two loading hoses are used in the blade holders in question. The parts of the doctor and the loading hoses are arranged so that one loading hose loads the blade and the other releases it. The return movement loading hose can also be used to create a counter-pressure, allowing a higher and more easily regulated pressure to be used in the loading hose. This is important, because the essential factor in adjustment and loading is the pressure difference, and not the pressure level. The usual pressure medium is air.

Loading hoses normally have an oval cross-section. The loading hose is set between the turning blade holder and its support. Generally, the loading hose is supported by its widest sides against the support surfaces. Over a certain distance, the loading hose operates as desired, in other words, the thickness of the hose increases, while its width remains essentially the same. However, in known loading hoses, this operational distance is short, and, as the distance between the support surfaces increases further, the loading hose assumes an increasingly round shape. In this case, the force created by the loading hose suddenly drops, which is extremely disadvantageous in terms of loading. In addition, known loading hoses are flexible in all directions, so that when the loading varies they move between the blade holder and the support and can even hang partly outside these. This causes variations in the loading force over the length of the doctor. In addition, when the blade returns, the part of the loading hose that is hanging loosely can be squeezed, and even broken, between the parts of the doctor or coating device.

SUMMARY OF THE INVENTION

The present invention provides a new type of loading hose for use in the doctor or coating device of a paper machine, which eliminates the defects of the prior art and creates the desired loading profile in the blade.

More specifically, the present invention provides a loading hose for use in a paper machine doctor or coating device, which loading hose is located between the doctor's or coating device's blade support and rotatably arranged blade holder. The loading hose is arranged to load the doctor blade of the doctor or the coating blade of the coating device, and incorporates a flexible casing, which is pressure-resistant and of a uniform cross-section. The loading hose includes at least one stiffening member attached to the casing, which is arranged to lie against one of the blade support or the blade holder.

The stiffening member comprises stiffening plates, at least one of which is manufactured from a composition material to create a friction or sliding effect. Alternatively, the stiffening member comprises stiffening plates, on top of one of which a layer is arranged to create a friction or sliding effect. The layer may comprise friction or sliding plates, which are narrower than the stiffening plate or the friction or sliding plates may comprise at least two narrow parts.

In yet another arrangement the layer is a surfacing.

Additional plates may be provided inside the loading hose at the location of the stiffening members, the width of which is essentially the same as that of the stiffening members.

Part of the cross-section of a loading hose according to the invention is rigid, so that it cannot become detrimentally rounded. The hose is also stiff enough longitudinally to ensure that it remains in place, even if contact is lost with the support surfaces. This makes it less probable that the hose will hang loosely and be broken. In addition, there is less variation in the level of force arising from changes in the distance between the moment point and the loading hose. The loading profile of the blade also remains as desired over the entire length of the doctor or coating device while the installation of the loading hose is facilitated. In addition, the friction properties of the loading hose can be altered if required, which also facilitates installation, among other things.

These and other features and advantages of the invention will be more fully understood from the following detailed description of the invention taken together with the accompanying drawings.

DETAILED DESCRIPTION OF THE INVENTION

Figure 1:
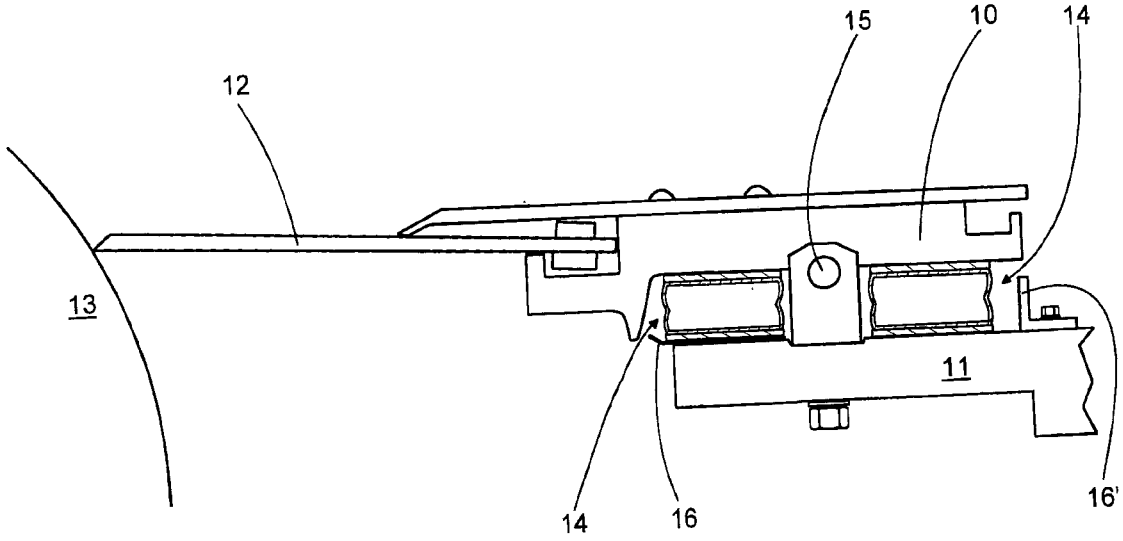
FIG. 1 is a side view of a hose-loaded doctor, illustrating cross-sections of loading hoses according to the invention installed in it.

Referring now to the drawings in detail, FIG. 1 shows a side view of a conventional hose-loaded doctor. The doctor includes a blade holder 10 and blade support 11, which is attached to the frame of the doctor (not shown) . The actual doctor blade 12 is fitted to blade holder 10, and is used to doctor the surface of roll 13. In a hose-loaded doctor, blade holder 10 is jointed to rotate in blade support 11, while loading hoses 14 are located between them. Loading hoses 14 are used to rotate doctor blade 12 in relation to joint 15.

Compressed air is fed to loading hoses 14, later referred to simply as hoses, when they thicken and thus create a force in their counter-surfaces. Here, the counter-surfaces are the blade holder 10 and the blade support 11. Usually, the actual loading hose is further from the doctor blade and the return hose is closer to it. Normally, both hoses are of the same kind, so that there are as few hose models as possible in use and it is possible to change the hoses around.

Though hoses 14 are not actually attached to blade support 11, their movement is nevertheless restricted. Suitably shaped blade support 11 and blade holder 10 limit the space available to hoses 11, and, if necessary, various kinds of stops 16, 16' are used to hold hoses 14 in place. The movement created in the doctor blade by the hoses is relatively short, so that the entire doctor blade is usually jointed to rotate. This allows the doctor to be moved a sufficient distance from the roll, for example, when changing the roll. By turning the doctor backwards a short distance from the roll, it is possible to use the hoses to finally load the doctor blade with a suitable and adjustable force. If necessary, the return hose can be used to lift the doctor blade off the surface of the roll.

Figure 2:
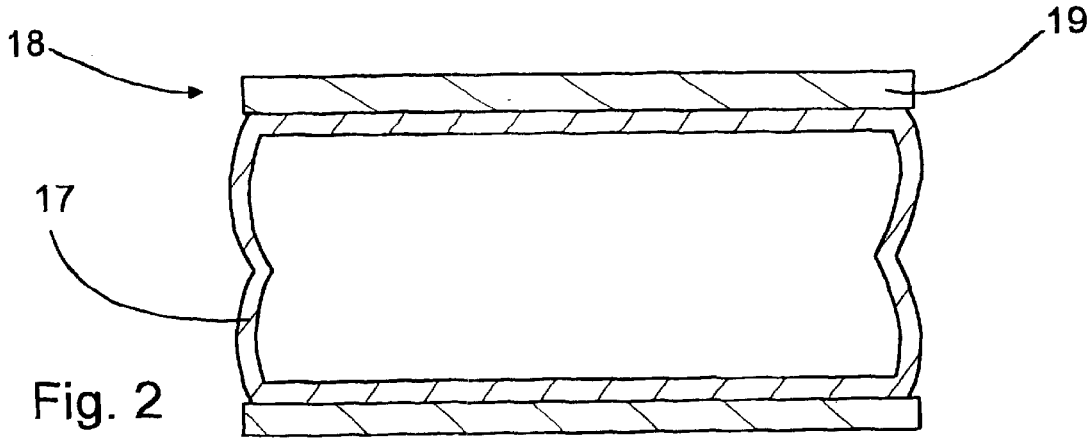
FIGS. 2–4 are cross-sectional views of various embodiments of the loading hose according to the invention.
Figure 3:
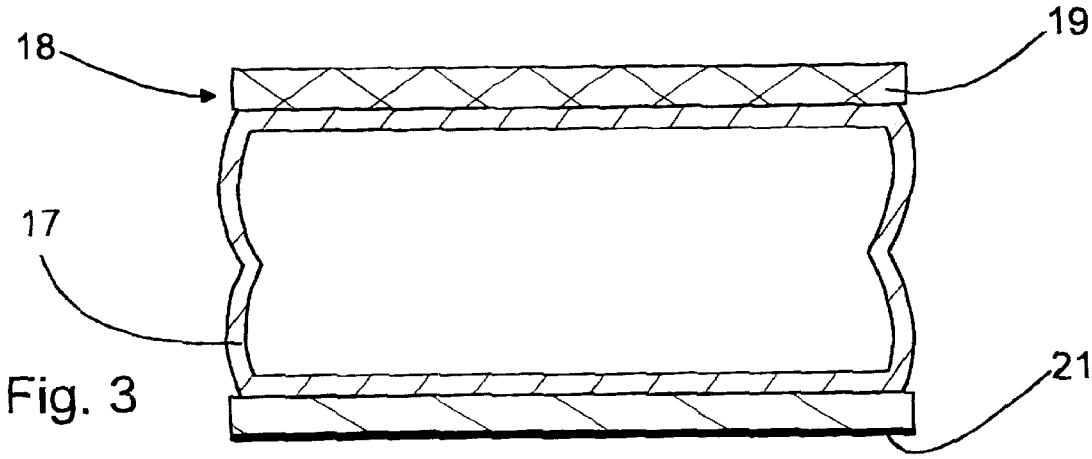
Figure 4:
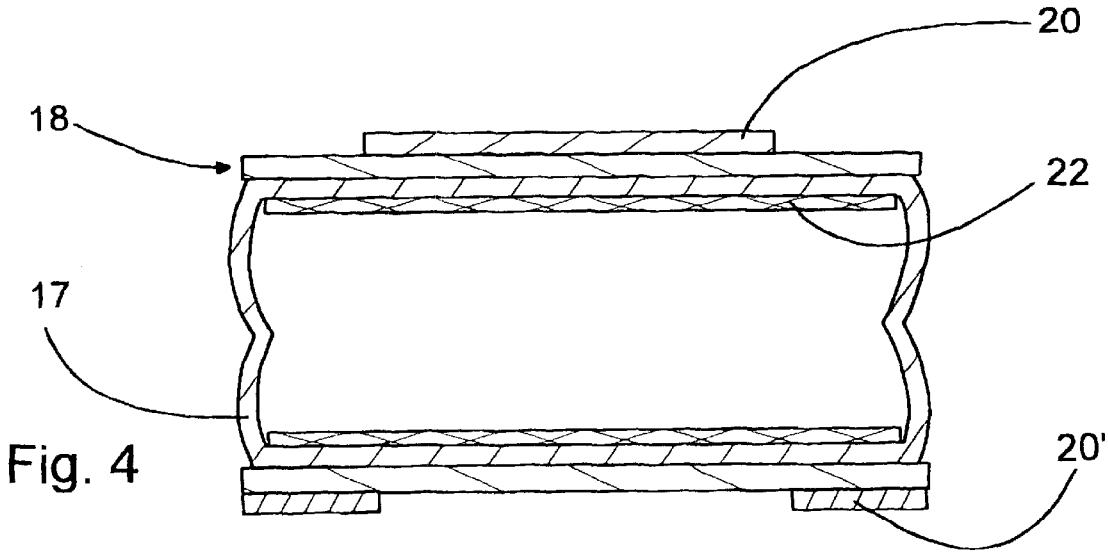

FIGS. 2–4 show cross-sections of various embodiments of a loading hose according to the present invention. According to the invention, loading hose 14 includes at least one stiffening member 18 attached to casing 17, which is arranged to lie against either blade support 11 or blade holder 10. The counter-surfaces can be suitably shaped to partly eliminate the rounding of the hose, in which case a single stiffening member is sufficient. Preferably, however, stiffening members 18 are attached to both sides of the casing 17 of hose 14. Thus, hose 14 cannot become detrimentally rounded, so that no sudden changes will take place in the loading profile of doctor blade 12. In the same way, hose 14 will also be stiffened longitudinally, making it easier to install. Hose 14 also remains in place better and parallel to the doctor. Stiffening members 18 are preferably attached by gluing. One of the stiffening members 18 is arranged to lie on blade support 11 and the other on blade holder 10 (FIG. 1). Thus, when the pressure is increased, only the thickness of hose 14 increases, so that the loading acts in the correct direction. The casing of the hose can bulge outward, as is usually the case. Alternatively, there may be folds in casing 17 according to the examples, so that its width remains nearly constant while its thickness changes. The stiffening members cover most of the circumference of the hose. If the width of the stiffening members is increased, however, the operating movement of the hose will correspondingly shorten. The optimum width is determined for each individual case. The casing of the hose itself is resistant to pressure and thus airtight.

FIG. 2 shows the basic model of the loading hose according to the invention. Here, stiffening plates 19 are attached to both sides of casing 17, and prevent hose 14 from becoming rounded. Stiffening plate 19 can be, for instance, made from fibre-reinforced plastic, in which staple or oriented reinforcing fibers are used. FIG. 3 shows the next embodiment of hose 14. Generally, the stiffening members 18 comprise stiffening plates 19, of which either one or both are manufactured from composition material, to provide friction or sliding characteristics. Here, the upper stiffening member is made from a composition material. The use of a composition material mainly affects the friction and sliding characteristics of the stiffening plate, as well as its wear resistance. This allows the hose to be made as required either to remain in place as firmly as possible or to slide as easily as possible in relation to its counter-surface. For example, in oscillation embodiments, the properties of the stiffening members can be selected to give a high degree of friction between the blade support and the corresponding stiffening member. Similarly, there can be low friction between the blade holder and the corresponding stiffening member. Thus, the hose will remain firmly in place and not hang loosely. The blade holder will, however, slide easily over the upper surface of the hose. In holder oscillations, this will reduce both the force required for the oscillation and the wear in the hose.

Besides a composition material, separate layers can also be used to create a friction or sliding effect. A friction or sliding effect refers not only to the desired slipping or grip of the stiffening plate, but also its resistance to wear. In practice, such stiffening members are formed by stiffening plates, on the surface of one or other of which the aforesaid layer is arranged. In FIG. 4, the upper layer is formed by friction or sliding plate 20, which is narrower that stiffening plate 19. Correspondingly, the lower friction or sliding plate 20' is formed of two parts. The friction or sliding plate can also comprise several parts or be as wide as the stiffening plate. By using friction or sliding plates of varying width, it is possible to vary the friction and sliding properties and loading points of the hose. In addition, a full-width friction or sliding plate will increase the stiffness of the hose. Alternatively, the aforesaid layer can be a surfacing 21 (FIG. 3). For example, the surfacing can be fluor and PTFE plastics, so that the stiffened surface can be made slippery. Surfacing can also be used to increase friction. It is easy to add a surfacing on top of the stiffening plate while scarcely increasing the total weight of the hose.

Inside the hose in FIG. 4, there are also corresponding additional plates 22 at the locations of stiffening members 18. The additional plates are essentially the same width as the stiffening members. In this case, the internal pressure of the hose presses the additional plates 22 against the stiffening plates 19, increasing the retention of the stiffening plates 19. The effect of additional plates 22 is great precisely at the edges of stiffening plates 19, where the greatest stress arises in the gluing, when hose 14 expands. The additional plates 22 do not require particularly strong attachment, as the pressure pushes them against casing 17.

A loading hose according to the invention remains firmly in place and is easy to install. In addition, there are no sudden changes in the doctor blade loading profile created by the hose, so that the loading can be precisely adjusted over the entire operating area of the hose-loaded doctor. In the case of the friction or sliding plates and additional plates, various combinations can be made as required. However, a loading hose according to the invention always includes at least one stiffening member attached to the casing, to prevent rounding.

Although the invention has been described by reference to a specific embodiment, in connection with doctors and doctor blades, it should be understood that numerous changes may be made within the spirit and scope of the inventive concepts described such as being equally suitable for use in connection with hose-loaded coating devices and their coating blades.

Accordingly, it is intended that the invention not be limited to the described embodiments, but that it have the full scope defined by the language of the following claims.

What is claimed is:

1. A loading hose in a paper machine doctor or coating device, which loading hose is located between the doctor's or coating device's blade support and rotatably arranged blade holder, is arranged to load the doctor blade of the doctor or the coating blade of the coating device, and which loading hose incorporates a flexible casing, which is pressure-resistant and of a uniform cross-section, characterized in that the loading hose includes at least one stiffening member attached to the casing, which is arranged to lie against one of the blade support or the blade holder.

2. A loading hose according to claim 1, characterized in that the stiffening member comprises stiffening plates, at least one of which is manufactured from a composition material to create a friction or sliding effect.

3. A loading hose according to claim 1, characterized in that the stiffening member comprises stiffening plates, on top of one of which a layer is arranged to create a friction or sliding effect.

4. A loading hose according to claim 3, characterized in that the layer comprises friction or sliding plates, which are narrower than the stiffening plate.

5. A loading hose according to claim 4, characterized in that the friction or sliding plates comprise at least two narrow parts.

6. A loading hose according to claim 3, characterized in that the layer is a surfacing.

7. A loading hose according to claim 1, characterized in that there are corresponding additional plates inside the loading hose at the location of the stiffening members, the width of which is essentially the same as that of the stiffening members.

8. A loading hose according to claim 2, characterized in that there are corresponding additional plates inside the loading hose at the location of the stiffening members, the width of which is essentially the same as that of the stiffening members.

9. A loading hose according to claim 3, characterized in that there are corresponding additional plates inside the loading hose at the location of the stiffening members, the width of which is essentially the same as that of the stiffening members.

10. A loading hose according to claim 4, characterized in that there are corresponding additional plates inside the loading hose at the location of the stiffening members, the width of which is essentially the same as that of the stiffening members.

11. A loading hose according to claim 5, characterized in that there are corresponding additional plates inside the loading hose at the location of the stiffening members, the width of which is essentially the same as that of the stiffening members.

12. A loading hose according to claim 6, characterized in that there are corresponding additional plates inside the loading hose at the location of the stiffening members, the width of which is essentially the same as that of the stiffening members.

* * * * *

UNITED STATES PATENT AND TRADEMARK OFFICE

CERTIFICATE OF CORRECTION

PATENT NO. : 6,361,656 B1
DATED : March 26, 2002
INVENTOR(S) : Ilkka Rata

It is certified that error appears in the above-identified patent and that said Letters Patent is hereby corrected as shown below:

Title page,
Correct Item [74] *Attorney, Agent or Firm* as follows:
Delete "Filders & Outland, P.C." and add -- Fildes & Outland, P.C. --.

Signed and Sealed this

Twenty-eighth Day of May, 2002

*Attest:*

*Attesting Officer*

JAMES E. ROGAN
*Director of the United States Patent and Trademark Office*